US005146659A

United States Patent [19]

Spriggs, II et al.

[11] Patent Number: 5,146,659

[45] Date of Patent: Sep. 15, 1992

[54] TRIANGULAR WEAVING FRAME

[76] Inventors: Carl R. Spriggs, II, 227 Columbia Regency, Columbia, Mo. 65201; Carol L. Brack-Kaiser, 7001 Hillcreek Rd., Columbia, Mo. 65203

[21] Appl. No.: 620,134

[22] Filed: Nov. 30, 1990

[51] Int. Cl.[5] ..... D03D 29/00

[52] U.S. Cl. ..... 28/152; 139/29

[58] Field of Search ..... 28/152, 151, 149; 38/102.3, 102.4, 102.7, 102.91; 139/29, 34

[56] References Cited

U.S. PATENT DOCUMENTS

| | | | |
|---|---|---|---|
| 2,063,726 | 12/1936 | Collingbourne | 139/34 |
| 2,108,424 | 2/1938 | Bakely | 28/152 |
| 2,118,142 | 5/1938 | Belash | 28/152 |
| 2,190,813 | 2/1940 | Walker | 28/151 |
| 2,292,356 | 8/1942 | Belanger | 28/152 |
| 2,312,388 | 3/1943 | Clements | 28/151 |
| 2,433,307 | 12/1947 | Thomas | 28/152 |
| 2,451,207 | 10/1948 | Ferguson | 139/34 |
| 2,573,484 | 10/1951 | Phelps | 28/152 |
| 2,632,938 | 3/1953 | Kopf | 28/152 |
| 2,663,066 | 12/1953 | Berger et al. | 28/152 |
| 2,780,854 | 2/1957 | Dritz | 28/152 |
| 3,757,395 | 9/1973 | Nepon | 28/152 |
| 3,769,667 | 11/1973 | Cooper | 28/152 |
| 3,800,372 | 4/1974 | Daoust | 28/152 |
| 4,023,245 | 5/1977 | Zaltzman | 28/152 |
| 4,416,040 | 11/1983 | Towsley | 28/152 |

*Primary Examiner*—Werner H. Schroeder
*Assistant Examiner*—Amy Brooke Vanatta
*Attorney, Agent, or Firm*—Grace J. Fishel

[57] ABSTRACT

An adjustable triangular weaving frame for weaving woven pieces of various sizes. The frame has sections formed by three rails. Each rail has an upper surface with a row of generally vertical pins. Means are provided for shortening the effective length of the sections and proportionately changing the number of vertical pins in each section.

8 Claims, 2 Drawing Sheets

TRIANGULAR WEAVING FRAME

The present invention relates to a triangular weaving frame which can be adjusted in size.

BACKGROUND OF THE INVENTION

Triangular frame looms are used for weaving triangular shaped woven pieces which can be used as shawls or joined together for use as ponchos, afghans, bed throws and so forth. Usually, the frame comprises sections formed by three rails arranged in a right triangle so that two woven pieces joined along their hypotenuse form a square. The length of the sections formed by the rails in the triangular frame determines the size of the finished piece. For greater flexibility in design, it would be desirable if the effective length of the sections formed by the rails could be shortened.

Weaving on a triangular frame loom is different from weaving on a conventional floor loom or even a rectangular frame loom as there is no need to measure and cut warp yarns, to dress the loom with warp yarns or to wind shuttles with weft yarns before weaving. With a triangular frame loom (as more particularly described below), the entire operation can be done with a center pull ball of yarn.

Weaving on a triangular frame loom requires that there be an equal number of vertical pins in each section and that the pins intersect at the corners. It is also important that the spacing of the pins be uniform in each section and that there be no gaps at the corners. Adjustable weaving frames are available for rectangular weaving frames, hexagonal weaving frames and the like. No comparable provisions have been made for triangular weaving frames taking into consideration their peculiar requirements.

In view of the above, there is a need for a triangular weaving frame which can be adjusted in size.

SUMMARY OF THE INVENTION

The main feature of the present invention is to provide an adjustable triangular weaving frame for weaving woven pieces of various sizes. The frame comprises sections formed by three rails. Each rail has first and second adjoining rails. Each rail also has upper and lower surfaces, inner and outer side edges and end edges and a row of generally vertical pins rising from the upper surface of the rail for winding string or yarn thereon in the formation of a woven piece. The vertical pins are set at regular intervals along each rail. Means are provided for connecting the rails together in a selected position to form one of a plurality of plane triangles of the same shape but different size. The spacing between the pins is regulated by the law of triangles such that there is an equal number of pins on each of the rails when the rails are assembled into one of said plane triangles of the same shape but different size.

An important object of the present invention is to provide an adjustable triangular weaving frame which maintains an equal number of vertical pins in each section.

Another object is to provide an adjustable triangular weaving frame which permits the vertical pins to intersect at the corners.

Yet another object is to provide an adjustable triangular weaving frame which maintains the uniform spacing of the vertical pins so that there are no gaps at the corners.

Other objects and features of the invention will be in part apparent and in part pointed out hereinafter.

The invention accordingly comprises the constructions hereinafter described, the scope of the invention being indicated by the subjoined claims.

BRIEF DESCRIPTION OF THE DRAWINGS

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
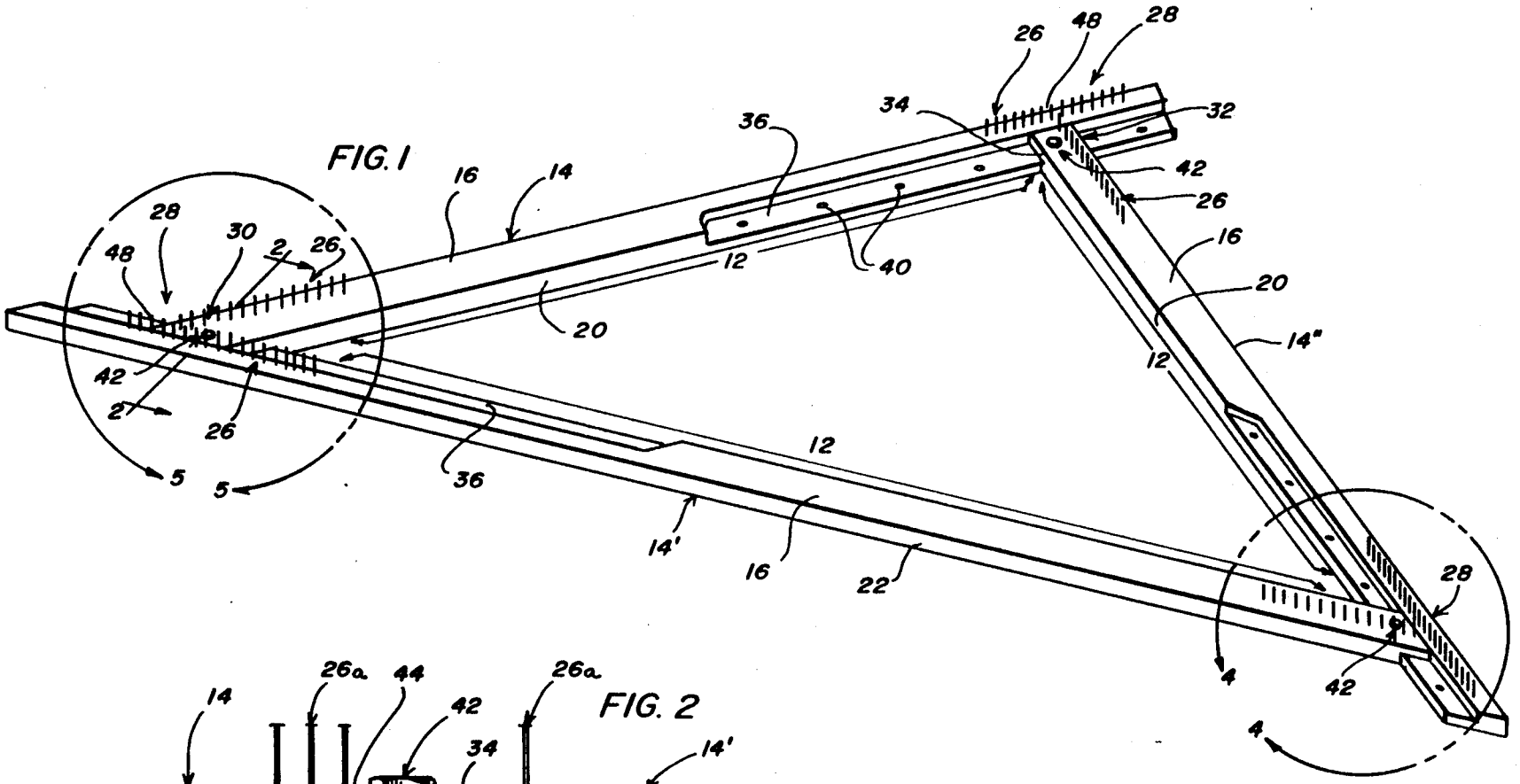
FIG. 1 is a perspective view of an adjustable triangular weaving frame in accordance with the present invention.
Figure 2:
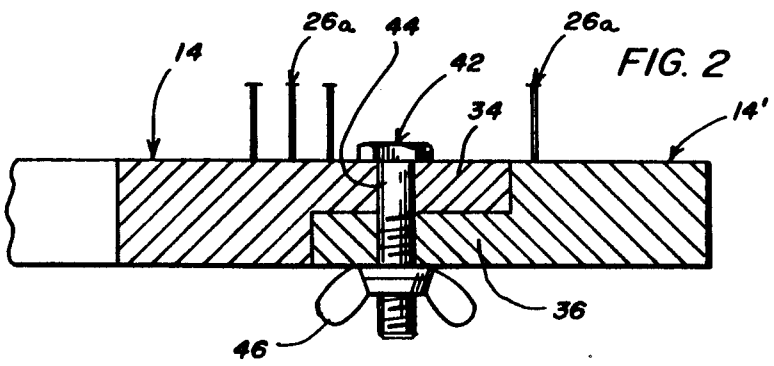
FIG. 2 is a section taken along line 2—2 in FIG. 1.
Figure 3:
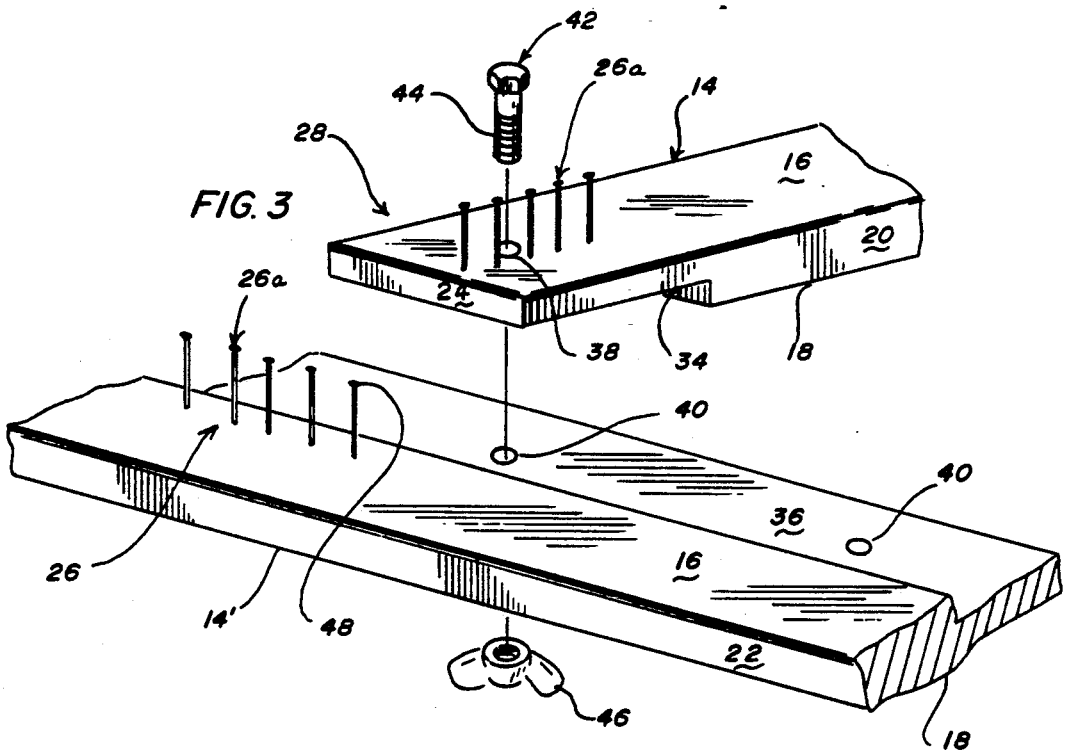
FIG. 3 is an exploded perspective view of a lap joint in accordance with the present invention.

Referring to the drawings, an adjustable triangular weaving frame 10 is shown in FIG. 1. Adjustable triangular weaving frame 10 comprises sections 12 formed by three rails. Each rail 14 has first and second adjoining rails 14' and 14'', respectively, and upper and lower surfaces 16 and 18, respectively, inner and outer side edges 20 and 22, respectively, and end edges 24. (The rails in FIG. 1 were arbitrarily numbered starting in the 12 o'clock position moving counterclockwise designating upper rail 14, lower rail 14' and right rail 14''). Each of rails 14, 14' and 14'' has a row 26 of generally vertical pins **26*a* rising from upper surface 16 of the rail for winding string or yarn thereon in the formation of a woven piece. The vertical pins 26*a* in rows 26 on each rail 14, 14' and 14'' are equally spaced so that there are an equal number of pins in each section 12 of a frame formed with said adjustable triangular weaving frame 10. A means 28 for connecting the rails together in a selected position to form one of a plurality of plane triangles of the same shape but different size is provided at each corner of the frame. Pins 26 *a* are set at regular intervals along each rails 14, 14' and 14''** with the spacing regulated by the law of triangles such that there is an equal number of pins on each of the rails when the rails are assembled into one of said plane triangles of the same shape but different size.

As illustrated in FIG. 1, it is preferred that adjustable triangular weaving frame 10 be formed as a right triangle with sections 12 in rail 14 and rail 14'' being equal in length and at right angles and section 12 of rail 14' forming a hypotenuse. Means 28 for connecting the rails together comprises first and second joints 30 and 32, respectively. First joint 30 is formed by one end of each rail 14 partially lapping inner side edge 20 of first adjoining rail 14' at a selected one of a plurality of positions along said first adjoining rail's inner side. Second joint 32 is formed by one end of each rail 14 partially lapping an end of second adjoining rail 14'' at a selected one of a plurality of positions along rail 14's inner side edge 20.

First and second lap joints 30 and 32 may be formed in a variety of ways (e. g., tongue in groove and so forth) not specifically illustrated but intended to be included in the description of a lap joint. In the preferred embodiment (which is illustrated in the drawings), each of rails 14, 14' and 14" has a protrusion 34 formed by notching one end and an elongated groove 36 along its inner side edge 20 adjacent its other end. First lap joint 30 is formed by lapping protrusion 34 of rail 14 flush into groove 36 of first adjoining rail 14' and second lap joint 32 is formed by lapping protrusion 34 of second adjoining rail 14" flush into groove 36 of rail 14 whereby the effective, length of sections 12 can be shortened by moving said protrusion 34 along said grooves 36. While the order of lapping could be reversed, it is preferred that rail 14 lap over upper surface 16 of first adjoining rail 14' and that rail 14 lap under the end of second adjoining rail 14".

A hole 38 is provided in each protrusion end, 34 of rails 14, 14' and 14" and a plurality of, holes 40 are provided in grooves 36 at selected intervals. Means 28 for connecting the rails together comprises a fastener 42 shown as a bolt 44 and a wing nut 46. As illustrated, one fastener 42 is received in each hole 38 in each protrusion end 34 and the selected hole 40 in each groove 36. The interval between holes 40 in grooves 36 is selected so that a movement of one space inboard or outboard along rails 14, 14' and 14" adds or subtracts the same number of pins to row 26 so that the number of pins in each section 12 remains equal.

Row 26 of vertical pins **26*a* on rail 14 extends the length of the rail at first joint 30 and intersects row 26 of vertical pins 26*a* on first adjoining rail 14' at a vertical pin on first adjoining rail 14' forming a vertex pin 48 which is equally spaced with the other pins in row 26 of vertical pins 26*a* on rail 14. Similarly, row 26 of vertical pins 26*a* on second adjoining rail 14" extends the length of rail 14" at second joint 32 and intersects row 26 of vertical pins 26*a* on rail 14 forming a second vertex pin 48 which is equally spaced with the other pins in row 26 of vertical pins 26*a* on second adjoining rail 14"** so that there are no unequal gaps between the vertical pins in the intersecting rows at the joints.

As illustrated, first and second joints 30 and 32 are formed such that rails 14, 14' and 14" form a frame which is uniform in breadth and thickness throughout. It is also preferred that upper and lower surfaces 16 and 18 be relatively broader and inner and outer side edges 20 and 22 and end edges 24 be relatively thinner to minimize the mass of the frame, while maximizing its strength.

Figure 4:
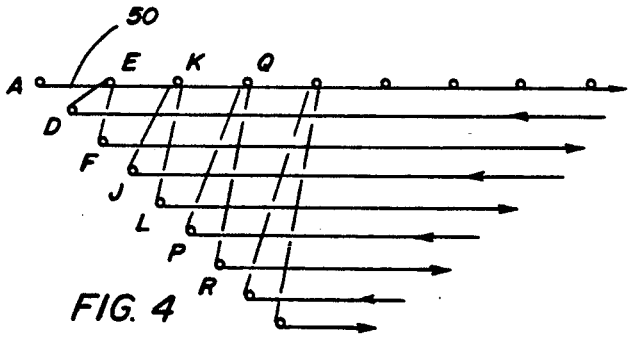
FIG. 4 is a detail taken along line 4—4 in FIG. 1 illustrating a woven piece in process of formation; and, FIG. 5 is a detail taken along line 5—5 in FIG. 1 of the woven piece in process of formation.
Figure 5:
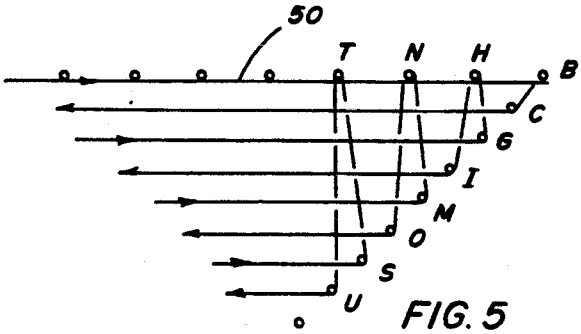

In use, adjustable triangular weaving frame 10 is adjusted to the desired size with means 28 for connecting the rails together The importance of vertical pins being spaced uniformly and of equal number between sections 12 and the importance that there be no large gaps between the vertical pins at the corners will be apparent with reference to FIGS. 4 and 5 where the pins are lettered alphabetically in order of use.

To begin a woven piece, the tail of a piece of yarn or string 50 is tied onto nail A on the left hand side of adjustable triangular weaving frame 10 as viewed in FIGS. 4 and 5 with a simple overhand knot, leaving enough tail for a fringe (if desired). Yarn 50 is carried across the loom to nail B, wrapping the nail in the direction shown. Yarn 50 is brought down and caught around nail C before crossing the loom again to nail D and then up to nail E. So far two warp yarns have been lain.

Since yarn 50 went over the first warp yarn in going from D to E, yarn 50 must go under that warp before going to F. This can be accomplished by reaching under the first warp with fingers or a crochet hook, grasping the yarn and pulling it down a few inches and creating a "U" with the yarn. The yarn 50 is then hooked on the left side of the "U" around F, then the right side of the "U", which includes the weave structure, is carried across the loom to G and H. As the yarn is carried across the loom, the weave structure both above and below the two warp yarns should be held so that the third (new) warp being lain does not get tangled with the others and so the weave is brought across the loom. The yarn is hooked first around G on the right side of the loom and then around H at the top in the order of the direction the yarn is headed.

Yarn 50 is now on the right side of the loom as viewed in FIGS. 4 and 5 and there are three warps lain. The second warp yarn is picked up and a loop of yarn is passed under it and hooked around nail I. The weave structure (the other half of the "U") is carried across the loom to the left to nails J and K, again holding the weave structure at both the bottom and top to keep the new warp from tangling with the first three warps. Each time a weave is formed on the left side of the loom, there will be an odd number of warps (numbering from the top of the loom in the order in which they were laid). Each time a weave is formed on the right side of the loom, there will be an even number of warps. Weaving is continued until the woven area progresses toward the center and closes.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed is:

1. An adjustable triangular weaving frame for weaving woven pieces of various sizes comprising sections formed by three rails connected to form a plane triangle, each rail having first and second adjoining rails and upper and lower surfaces and end and inner and outer side edges and each rail having a row of generally vertical pins rising from the upper surface of the rails for winding string or yarn thereon in the formation of a woven piece, said vertical pins set at regular intervals along each rail with the spacing regulated by the law of triangles such that there is an equal number of pins on each of the rails when the rails are assembled into plane triangles of the same shape but different size, and means for connecting the rails together in a selected position to form one of a plurality of plane triangles of the same shape but different size.

2. The adjustable triangular weaving frame of claim 1 wherein each rail has a protrusion at one end and an elongated a groove along its inner side edge adjacent its other end.

3. The adjustable triangular weaving frame of claim 2 wherein said means for connecting the rails together comprises first and second lap joints, said first joint formed by lapping the protrusion of each rail into the groove of the first adjoining rail and said second joint formed by lapping the protrusion of the second adjoining rail into the groove of each rail whereby the size of the planar triangle can be changed by moving said protrusions along said grooved sides.

4. The adjustable triangular weaving frame of claim 3 wherein a hole is provided in each protrusion and a plurality of holes are provided along each grooved side at selected intervals, said means for connecting the rails together comprising a fastener received in each said hole in each protrusion and the selected hole in each grooved side.

5. An adjustable triangular weaving frame for weaving woven pieces of various sizes comprising sections formed by three rails connected to form a plane triangle, each rail having first and second adjoining rails and upper and lower surfaces, inner and outer side edges and end edges and each rail having a row of generally vertical pins rising from the upper surface of the rail for winding string or yarn thereon in the formation of woven piece, said vertical pins set at regular intervals along each rail with the spacing regulated by the law of triangles such that there is an equal number of pins on each of the rails when the rails are assembled into plane triangles of the same shape but different size, and means for connecting the rails together in a selected position to form one of a plurality of plane triangles of the same shape but different size, said means for connecting the rails together comprising first and second joints, said first joint formed by one end of each rail partially lapping the inner side of the first adjoining rail at a selected one of a plurality of positions along said first adjoining rails's inner side and said second joint formed by each rail partially lapping an end of the second adjoining rail at a selected one of a plurality of positions along each rails's inner side, said row of vertical pins on the rail extending the length of the rail at the first joint and intersecting the row of vertical pins on the first adjoining rail at a vertical pin on the first adjoining rail forming a vertex pin which is equally spaced with the other pins in the row of vertical pins on the rail and said row of vertical pins on the second adjoining rail extending the length of the rail at the second joint and intersecting the row of vertical pins on said rail forming a vertex pin which is equally spaced with the other pins in the row of vertical pins on the second adjoining rail so that there are no unequal gaps between the vertical pins in the intersecting rows at the joints.

6. The adjustable triangular weaving frame of claim 5 wherein each rail partially laps the upper surface on the inner side of the first adjoining rail and wherein each rail partially laps under the end of the second adjoining rail.

7. The adjustable triangular weaving frame of claim 6 wherein each rail has a protrusion at one end and an elongated groove along its inner side adjacent its other end, said first joint formed by lapping the protrusion of each rail into the groove of the first adjoining rail and said second joint formed by lapping the protrusion of the second adjoining rail into the groove of each rail.

8. The adjustable triangular weaving frame of claim 7 wherein a hole is provided in each protrusion and a plurality of holes are provided along each grooved side at selected intervals, said means for connecting the rails together comprising a fastener received in each said hole in each protrusion and the selected hole in each grooved side.

* * * * *